US007574830B2

(12) United States Patent
Baker

(10) Patent No.: US 7,574,830 B2
(45) Date of Patent: Aug. 18, 2009

(54) HIGH STRENGTH LIGHTWEIGHT MATERIAL

(76) Inventor: Christopher Baker, 10007 NW. Lema, Apt. D, Kansas City, MO (US) 64152

( * ) Notice: Subject to any disclaimer, the term of this patent is extended or adjusted under 35 U.S.C. 154(b) by 0 days.

(21) Appl. No.: 11/833,993

(22) Filed: Aug. 4, 2007

(65) Prior Publication Data

US 2008/0078138 A1 Apr. 3, 2008

Related U.S. Application Data

(60) Provisional application No. 60/836,214, filed on Aug. 8, 2006.

(51) Int. Cl.

| | |
|---|---|
| ***E04G 11/04*** | (2006.01) |
| ***E04H 9/00*** | (2006.01) |
| ***E04H 15/20*** | (2006.01) |
| ***E04H 12/00*** | (2006.01) |
| ***E04B 7/08*** | (2006.01) |

(52) U.S. Cl. ..... 52/2.18; 52/1; 52/2.15; 52/81.1; 52/81.2; 52/81.3; 52/648.1; 52/649.1; 52/652.1; 52/653.1; 52/653.2

(58) Field of Classification Search ..... 52/648.1, 52/81.1, 81.2, 81.3, 1, 2.15, 2.18, 649.1, 52/652.1, 653.1, 653.2, DIG. 10
See application file for complete search history.

(56) References Cited

U.S. PATENT DOCUMENTS 845,787 A * 3/1907 Horix ..... 52/649.2
1,349,868 A * 8/1920 Atterbury ..... 52/381
2,140,283 A * 12/1938 Faber ..... 52/378
3,407,560 A * 10/1968 Baumann ..... 52/645
3,494,578 A 2/1970 Cureton
3,705,473 A * 12/1972 Yeffal-Rueda ..... 52/649.1
3,777,359 A 12/1973 Bardot
3,974,611 A 8/1976 Satterthwaite
4,156,997 A 6/1979 Decker et al.
4,179,979 A 12/1979 Cook et al.
5,005,800 A * 4/1991 Weisse ..... 249/175
5,070,673 A * 12/1991 Weisse ..... 52/793.1
5,087,516 A 2/1992 Groves
5,110,661 A 5/1992 Groves
5,187,203 A 2/1993 Lenox et al.
5,254,383 A 10/1993 Harpell et al.
5,259,695 A 11/1993 Mostkoff
5,430,989 A * 7/1995 Jones ..... 52/655.1
5,553,967 A 9/1996 Uozumi
5,738,925 A 4/1998 Chaput
5,804,757 A 9/1998 Wynne
5,961,365 A * 10/1999 Lambert ..... 446/125
6,061,969 A * 5/2000 Leary ..... 52/2.11
6,192,633 B1 * 2/2001 Hilbert ..... 52/2.18
6,260,306 B1 * 7/2001 Swetish et al. ..... 52/2.18
6,783,814 B2 8/2004 Sager et al.
6,829,869 B1 * 12/2004 Savoie ..... 52/648.1
2002/0056248 A1 * 5/2002 Warren ..... 52/648.1
2004/0107669 A1 * 6/2004 Francom ..... 52/697
2004/0182299 A1 9/2004 Kent et al.

* cited by examiner

*Primary Examiner*—Richard E Chilcot, Jr.
*Assistant Examiner*—Andrew J Triggs
(74) *Attorney, Agent, or Firm*—David E. Herron, II

(57) ABSTRACT

The disclosure depicts a high-strength yet lightweight material composed of interconnected struts that typically form a tetrahedral lattice structure.

13 Claims, 11 Drawing Sheets

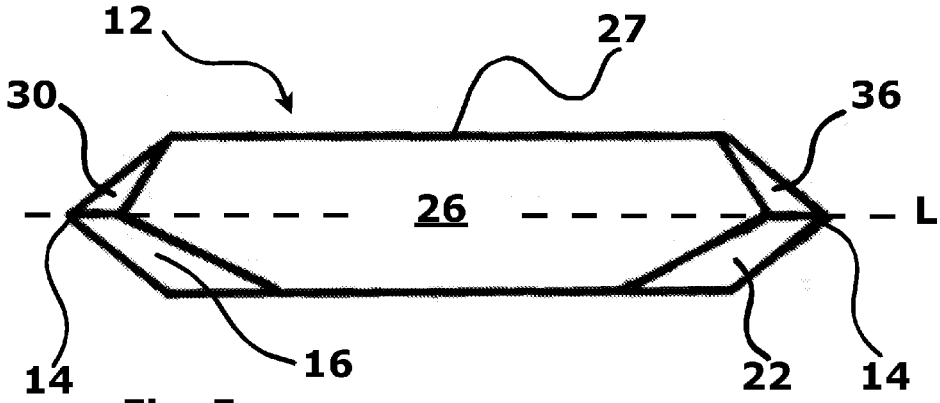
Fig. 5
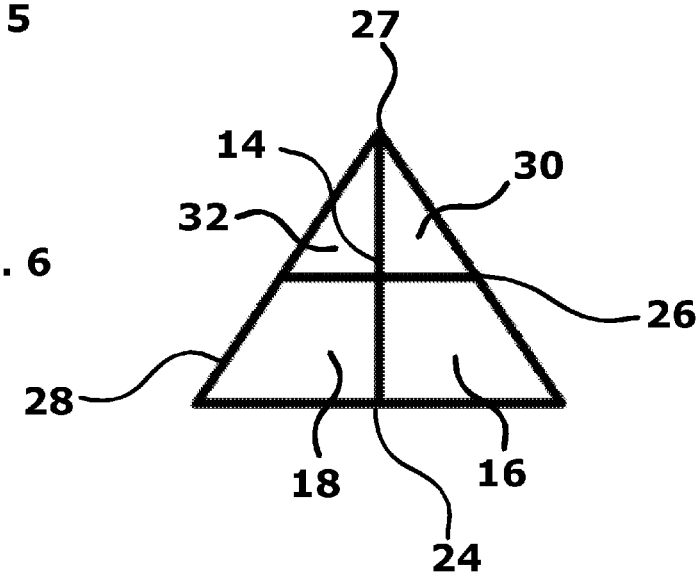
Fig. 6
Fig. 7
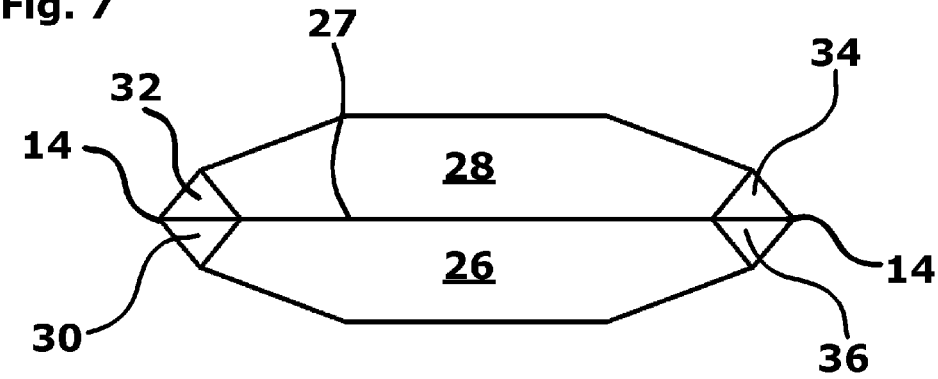

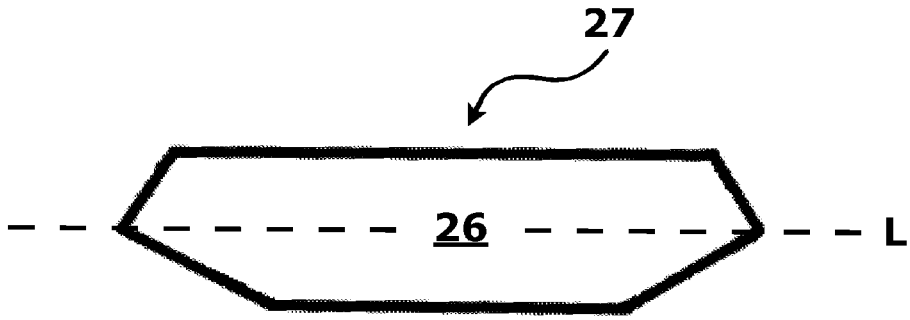
Fig. 10
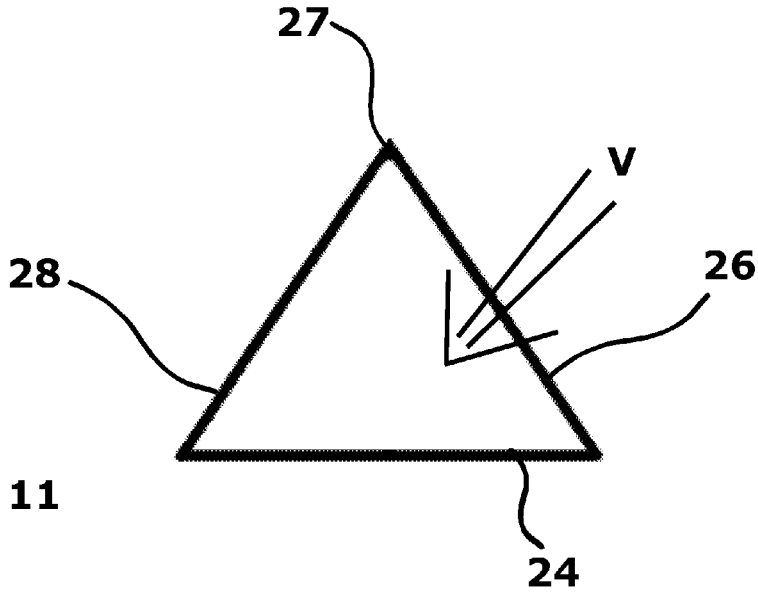
Fig. 11
Fig. 12
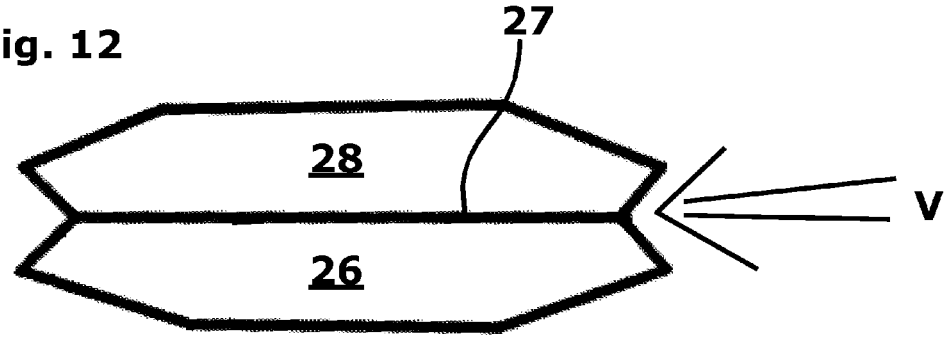

HIGH STRENGTH LIGHTWEIGHT MATERIAL

INCORPORATION BY REFERENCE

This application claims domestic priority under 35 USC §119(e) based upon provisional patent application No. 60/836,214 filed on Aug. 8, 2006. The entire provisional application No. 60/836,214 is hereby incorporated by reference as if set forth verbatim into this patent specification.

SUMMARY OF THE INVENTION

The invention is a high-strength yet lightweight material composed of interconnected struts that typically form a tetrahedral lattice structure. Each strut of the interconnected struts has first and second ends spaced from one another along a longitudinal axis. The strut has a generally triangular cross-section at planes perpendicular to this longitudinal axis. In a preferred embodiment, the triangular cross section comprises an isosceles triangle, with a pair of base-angles approximating 55 degrees. It is important that the first and second ends of each strut are equivalent to one another to facilitate the assembly of the struts into a lattice structure of these interconnected struts.

Each strut has a vertex point positioned at an outermost point with respect to the longitudinal axis. The vertex point is positioned on a line within a plane that symmetrically divides the triangular cross-section, and is the intersection point of a plurality of planar polygonal faces.

The first and second polygonal faces share a common edge and angle outwardly toward the vertex from the upper edge of the triangular cross-section. These first and second faces, preferably triangles, are generally symmetric about the common edge. Third and fourth faces of the end portions of the strut angle outwardly and upwardly from a base of the triangular cross section toward the vertex point. Preferably, the third and fourth faces share a common edge extending from the vertex point to the base of the triangular cross-section of the strut.

A manifold comprising fluid ducts may pass through each strut. In a preferred embodiment, a duct passes from the first face of one end of the strut to the second face of the other end. Another duct may do just the opposite and criss-cross it.

Comparatively, another pair of ducts may cross from the third and fourth faces of the opposing ends as well. Of course, other arrangements of the manifold are possible, including making the entire strut hollow so that a manifold can be created by interconnecting the struts into a lattice structure. Fluid may be injected, forced or moved through the manifold in order to regulate the temperature of the material.

The lattice structure, of course, will create a material that comprises struts and voids therebetween. The material may be made solid by pouring a filler (such as fiberglass, epoxy, concrete, or the like) into the lattice to fill these voids thereby creating a solid material.

Other objects, advantages and novel features of the present invention will become apparent from the following detailed description of the invention when considered in conjunction with the accompanying drawings.

BRIEF DESCRIPTION OF THE DRAWINGS

FIG. 5 shows a side view isolating a strut that comprises the lattice structure.

FIG. 6 is an end view isolating a strut that comprises the lattice structure.

FIG. 7 is a plan view isolating the strut that comprises the lattice structure

FIG. 10 is a bottom view isolating a second preferred embodiment of a strut that comprises the lattice structure.

FIG. 11 is a bottom view isolating the strut that comprises the lattice structure.

FIG. 12 is a plan view of isolating a second preferred embodiment of a strut that comprises the lattice structure.

DETAILED DESCRIPTION OF THE PREFERRED EMBODIMENTS

Figure 1:
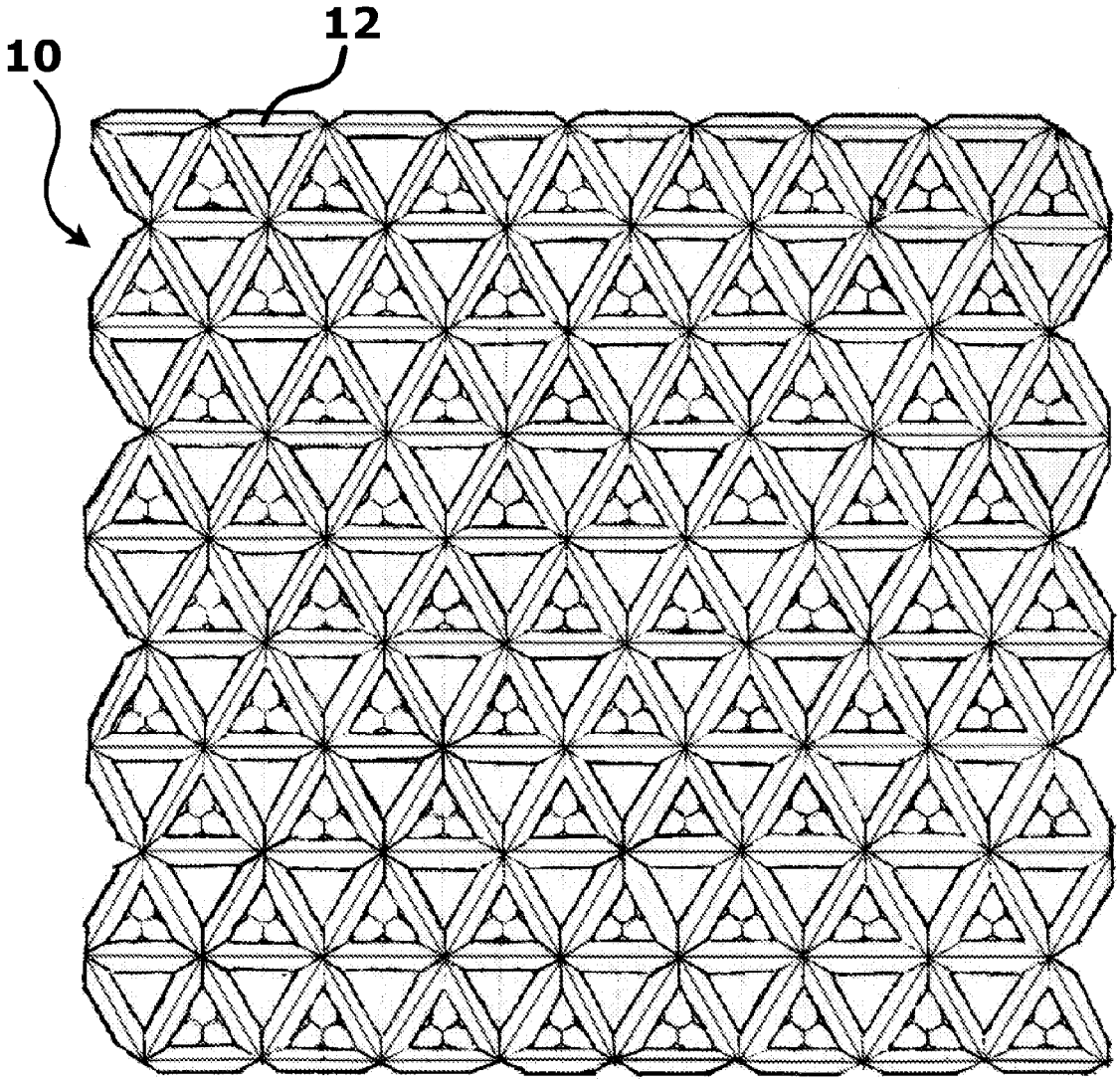
FIG. 1 is a perspective view of a first embodiment of the lattice structure, according to the principles of the invention.

FIG. 1 gives a perspective view of a first embodiment of the lattice structure, according to the principles of the invention. As shown, the lattice structure 10 comprises a plurality of interconnected struts 12 that form triangles within a plane, and extend to form a tetrahedral spatial structure. In selected planes, the struts 12 form triangular structures with space therebetween. It is well-known that triangular support structures provide very stable, durable support, and are likewise resistant to trauma. The instant design takes full advantage of this principle regarding triangles, and simultaneously generate a relatively lightweight lattice structure because much of the structure is open space.

Figure 2:
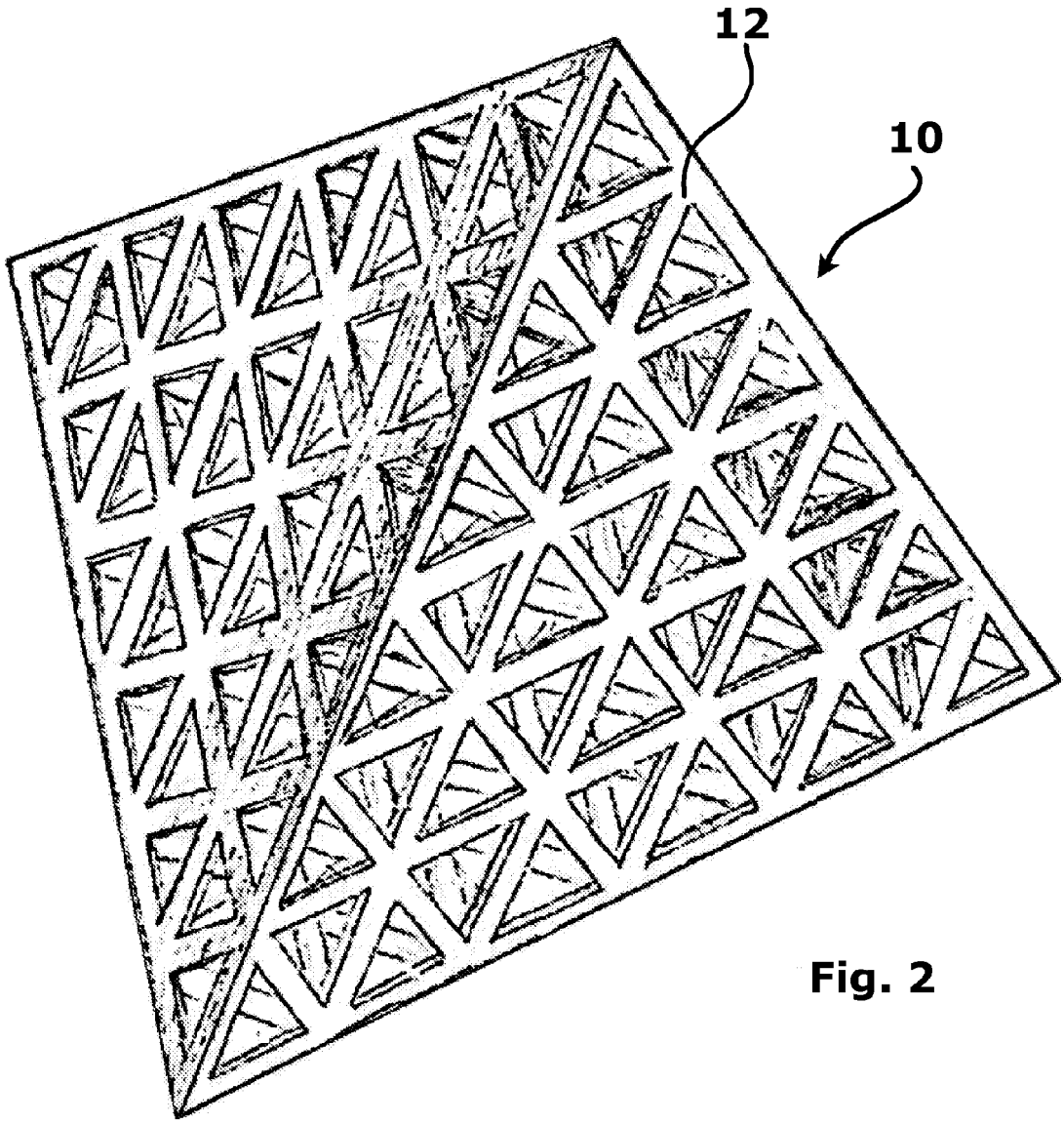
FIG. 2 shows a perspective view of an alternate embodiment of the lattice structure.

FIG. 2 shows a perspective view of an alternate embodiment of the lattice structure 10. The view shown in FIG. 2 shows a lattice structure 10 that forms the general shape of a tetrahedron. This embodiment of the lattice structure 10, as in previously discussed embodiment, will comprise interconnected struts 12 that form tetrahedral shapes within the lattice structure 10. Additionally, the tetrahedrally-connected struts 12 may interconnect to form any type of shape, including a planar structure (as in FIG. 1), or even a larger lattice that itself forms a tetrahedron, as depicted here in FIG. 2.

Figure 3:
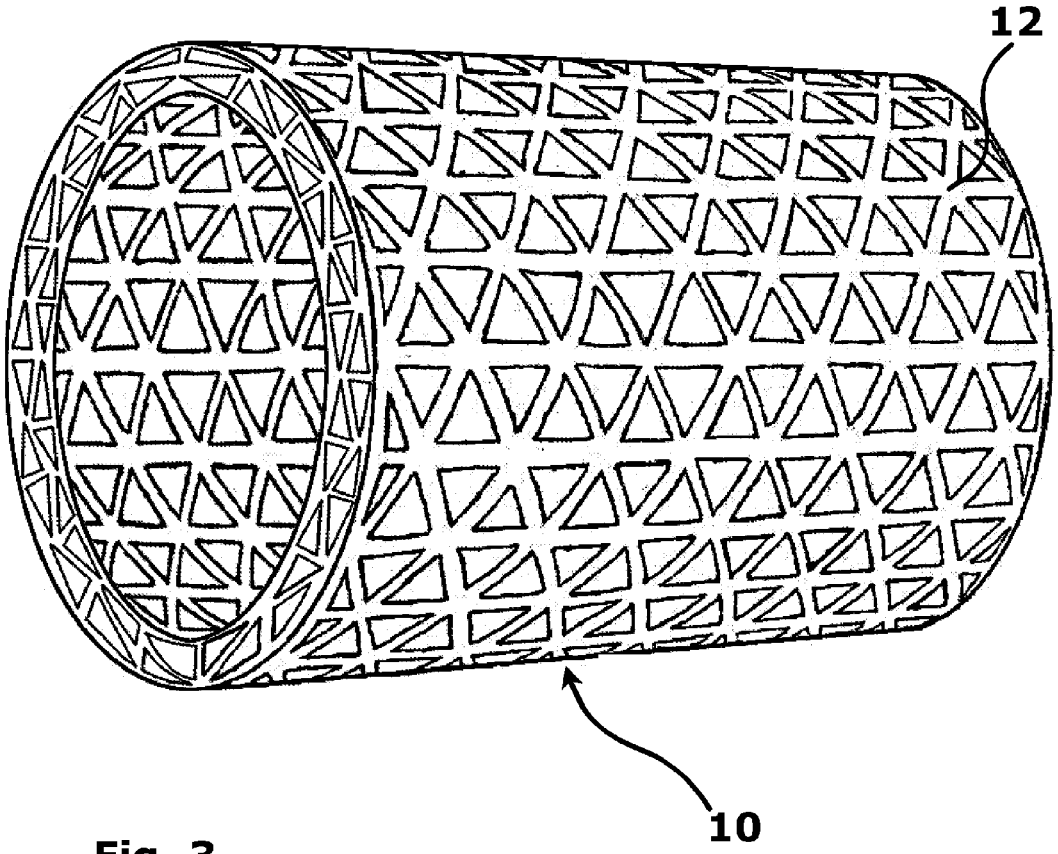
FIG. 3 shows a perspective view of another alternate embodiment of the lattice structure.

FIG. 3 shows a perspective view of yet another alternate embodiment of the lattice structure 10. In this embodiment, tetrahedrally-connected struts 12 are interconnected and formed to create a cylindrical lattice structure 10. This lattice structure may also comprise a hollow cylinder (as shown in FIG. 3), or it may comprise a generally-solid cylindrical structure.

FIG. 4 shows a perspective view that details how the lattice structure 12 may be used as an internal structure to enhance the durability of a solid material. In this embodiment, the lattice structure 10 is positioned within a mold 41, and material in molten or liquid form is poured into the mold. The material 43 can be any known material, such as fiberglass, polyurethane, plastic, or even concrete. It is found that the lattice structure 12 within any cured material will enhance the durability and make the material more resistant to trauma and wear.

Figure 4A:
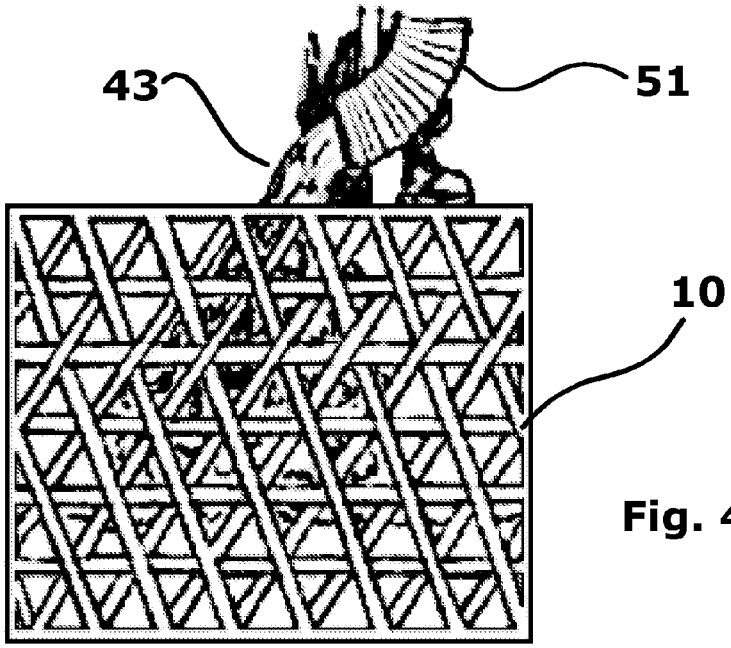
FIG. 4 shows a perspective view detailing a unique method that incorporates the inventive lattice structure.
Figure 4B:
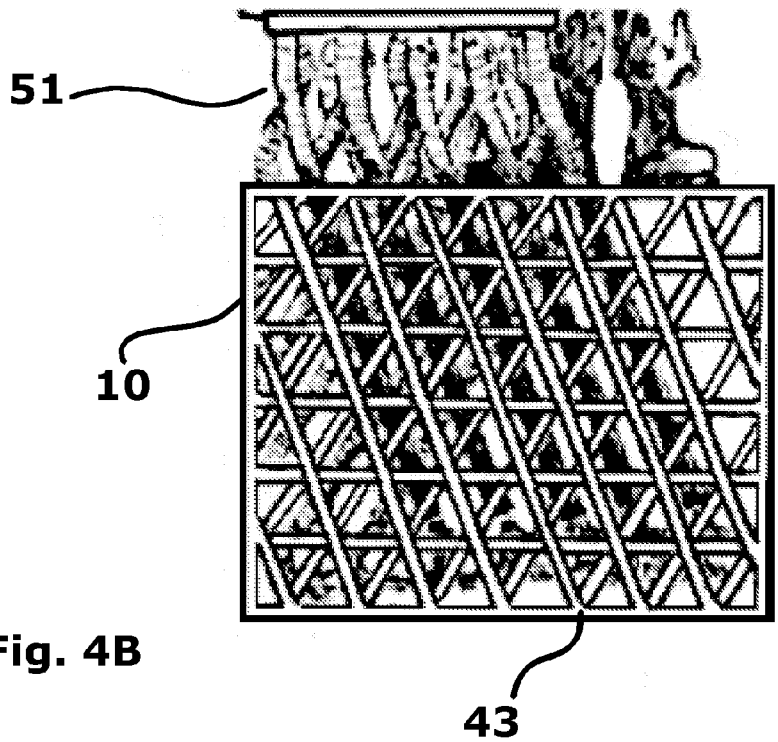

FIG. 4*a* shows an alternate perspective view of how the lattice structure 12 may be used as an internal structure to enhance the durability of a solid material. In this embodiment, material 43 is inserted into the lattice structure with an inserter 51 that is directed appropriately. Comparatively, FIG. 4*b* shows another embodiment of how material 43 may be inserted into the structure 12. In the alternate method depicted in FIG. 4*b*, the inserter 51 comprises numerous hoses or ducts that can penetrate into the lattice structure to better direct and manage insertion and filling of the lattice structure with material 43 in a more uniform manner.

FIG. 5 isolates the strut 12 and provides a side view thereof. The strut 12 extends along a longitudinal axis L to a vertex point 14 at an outermost point of each end of the strut 12. The first side 26 of the strut 12 is shown to bear a generally planar configuration, but other shapes and configurations are also within the scope of this invention. However, experimentation has shown that planar configurations are preferred for the ease of manufacture.

As shown in FIG. 5, the start 12 has a pair of opposed ends that are generally equivalent one another. For example, the first end face 16 bears an equivalent shape with the fourth end face 22 on the opposite end of the strut 12. Likewise, the fourth end face 30 is generally equivalent to the eighth end face 36.

FIG. 6 isolates the end view of the strut so that the configuration of the end faces 16,18,30,32 becomes more clear. The strut 12 bears a generally uniform isosceles triangular shape having a base 24 and legs 26 and 28. As shown, upper end faces 30 and 32 are adjacent the spine edge 27 that forms vertex of the isosceles triangle. Preferably, the angle at the spine edge is slightly greater than sixty degrees—approximately 70 degrees. The four end feces 16, 18, 30 and 32 share vertex point 14. Typically, the vertex point 14 is on a line that forms the altitude of the isosceles triangular cross-section. In that regard, the plane containing the altitude also provides a line of symmetry; note that the upper end faces 30,32 are symmetric about the altitude just as lower end faces 16,18 are symmetric about the altitude as well. The lower end faces 16,18 form right-angle trapezoids sharing a common edge through the altitude of the isosceles triangular cross-section.

FIG. 7 shows an overhead, plan view that isolates the strut 12. The strut 12 has first side 26 and a second side 28 that meet at spine edge 27. The spine edge 27 terminates where it adjoins the upper end feces 30,32 at one end, and upper faces 34 and 36 at the other. From the view shown in FIG. 7, the line defining spine edge 27 provides a line of symmetry for end faces 30 and 32. This same line through the spine edge 27 also provides a line of symmetry for end faces 34 and 36. Also, note that opposite upper end faces 32 and 34 are equivalent to one another, as are opposite end faces 30 and 36.

Figure 8:
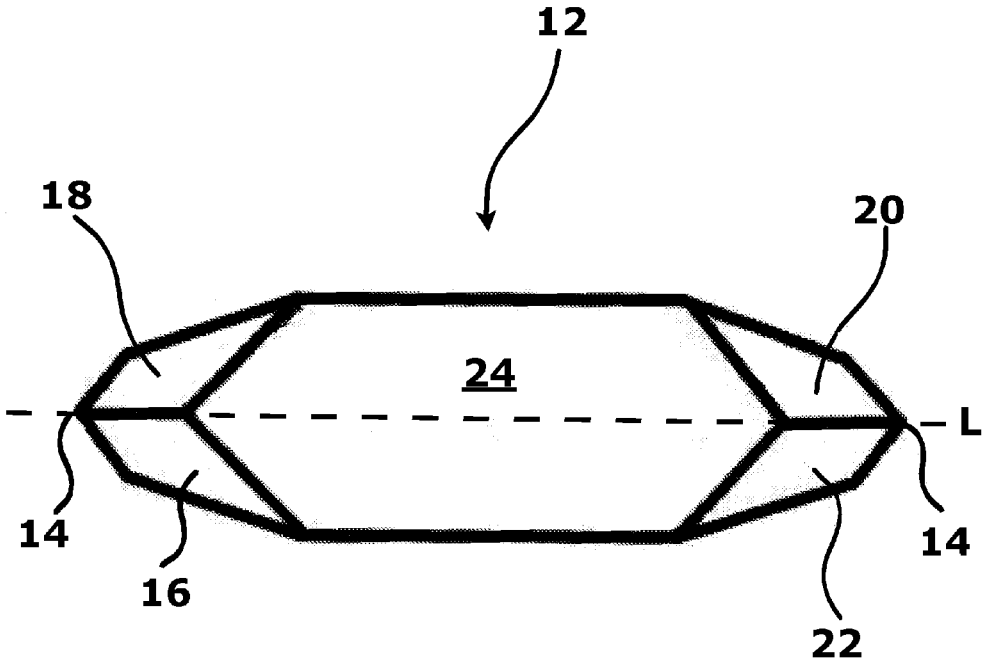
FIG. 8 is a bottom view isolating the strut that comprises the lattice structure.

FIG. 8 isolates the bottom view of the strut 12. The strut 12 has a base 24 that extends in a generally planar fashion along the longitudinal axis L of the strut, and terminates at each end with lower end laces 16, 18 at one end, and lower end faces 20,22 at the other. As shown in FIG. 8, the base forms a hexagonal shape bearing first line of symmetry about a plane through the longitudinal axis L, and a second line of symmetry about a line orthogonal to the longitudinal axis L.

Figure 9:
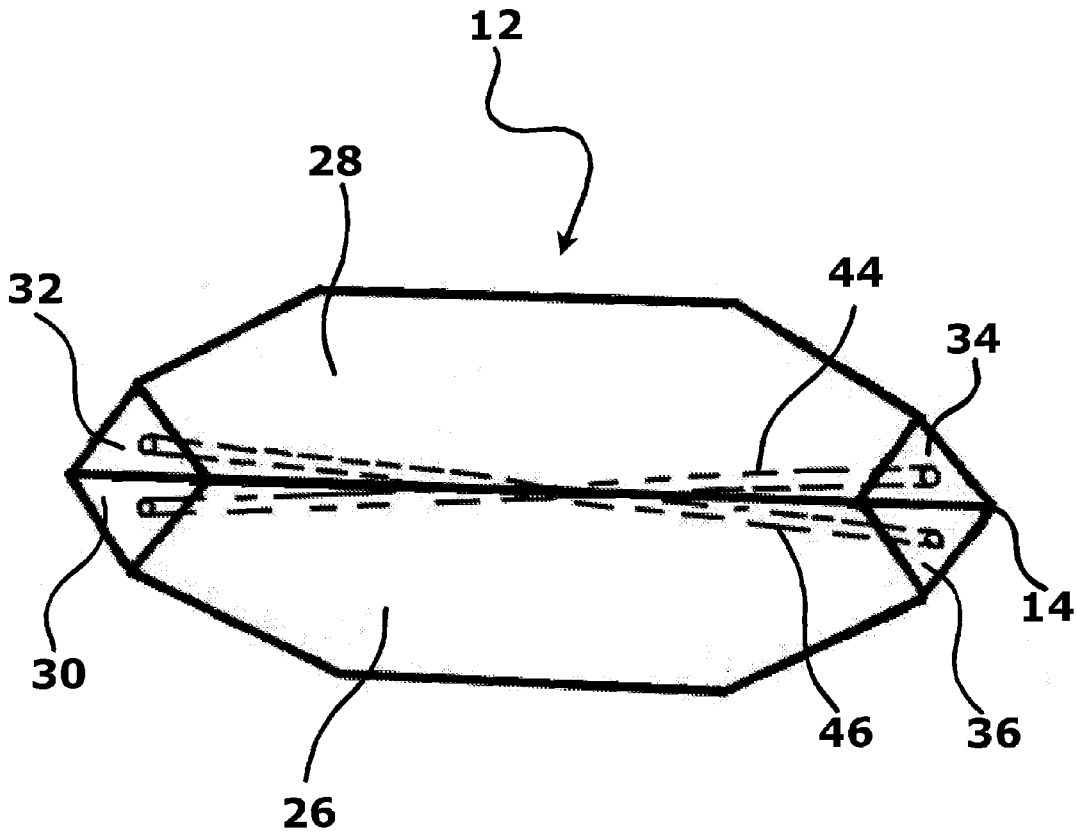
FIG. 9 is a plan view of isolating a second preferred embodiment of a strut that comprises the lattice structure.

FIG. 9 shows an overhead and plan view of alternate embodiment of the strut 12. Structurally and spatially, the view of strut 12 of FIG. 9 is equivalent to the overhead plan view shown in FIG. 7. For example, the strut in FIG. 12 has sides 26 and 28 that meet at spine edge 27. In that regard, the spine edge 27 terminates with upper end faces 16 and 18 at one end and upper end faces 34 and 36 at the other, just as the embodiment shown in FIG. 6. However, a pair of ducts 44, 46 pass through the interior of the strut 12. Specifically, the duct 46 passes from a first upper end face 32 at one end and terminates at the third upper end face 36 on the other. Note that the faces 32, 36 that are connected by duct 46 are on opposite sides of the line of symmetry that passes through the spine edge 27.

Still referring to FIG. 9, a second duct 44 passes from a second upper face 30 at one end of the strut 12 to the fourth upper face 34 at the opposite end of the strut 12. Analogously, the second upper face 30 and the fourth upper face 34 (which are connected by duct 44) are on the opposite sides of the line of symmetry that passes through spine edge 27. These ducts will criss-cross one another (and may intersect) at an interior point within the strut 12. These ducts 44, 46 will allow the struts 12, when assembled into a lattice structure (as in FIGS. 1-4) to create a manifold that allows cooling fluid to pass therethrough. Of course, the entire strut itself may be entirely hollow, which could also enable fluid to pass therethrough, even when assembled into a complex lattice structure as previously shown.

FIG. 10 isolates a bottom view of another embodiment, similar to the embodiment shown in FIG. 9 in that this embodiment bears a pair of criss-crossing internal ducts 48, 49. A first duct 48 extends between a first lower end face 18 on one end of the strut 12 to a third lower end face 22 on the other end. Conversely, there is a second duct 49 that passes from a second lower end face 16 at one end to a fourth lower end face 20 at the other. These ducts 48,49 will criss-cross one another (but not necessarily intersect) within an interior of the strut, and will allow the struts 12, when assembled to create a manifold that allows cooling fluid to pass through a network of struts.

FIG. 11 represents a plan view of alternate embodiment of the strut 12. In this embodiment, the interior portion of the strut is hollow; however, the remaining parts of the strut 12 are analogous. For example, the start of FIG. 11 includes a first side 26 that extends along a longitudinal axis L and terminates in an upper spine edge 27.

FIG. 12 shows an end view of a hollow embodiment of the start 12. In this view, the sides 26, 28 and base 24 form a generally triangular configuration that encloses a hollow void V. The hollow configuration of FIG. 12, of course, eliminates the end faces that are viewable in FIG. 6. Conversely, the embodiment of FIG. 12 also eliminates the vertex point 14 that is shown in FIG. 6 as well.

Figure 13:
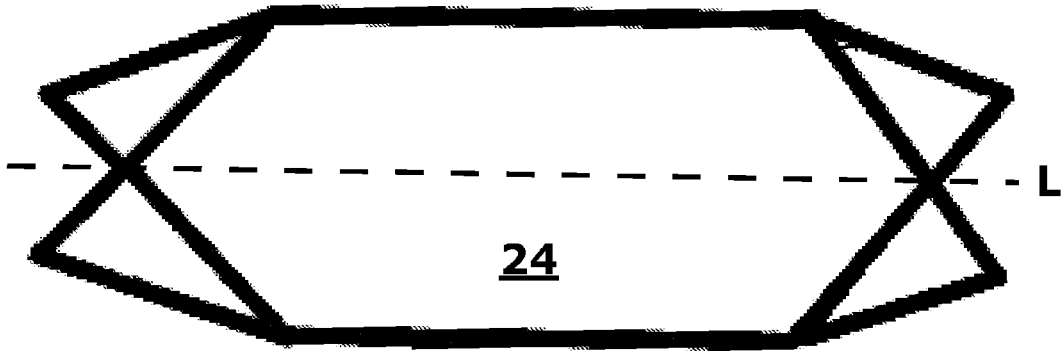
FIG. 13 is a bottom view isolating a second preferred embodiment of a strut that comprises the lattice structure.

FIG. 13 shows a bottom view of the hollow embodiment of the strut 12. As shown the base 24 that forms an elongate hexagon that extends along longitudinal axis L and terminates with a triangular configuration adjacent the opening for void V. The void V allows cooling fluid to pass through the strut; when interconnected into a lattice structure (as in FIGS. 1-4), the void V allows cooling fluid to circulate through the entire lattice structure. Additionally, other devices or items, such as sensors, wiring, pumps, filters, motors, electronic devices, or the like may be positioned within the voids V. These devices may be positioned exterior the struts and within the lattice structure.

Figure 14:
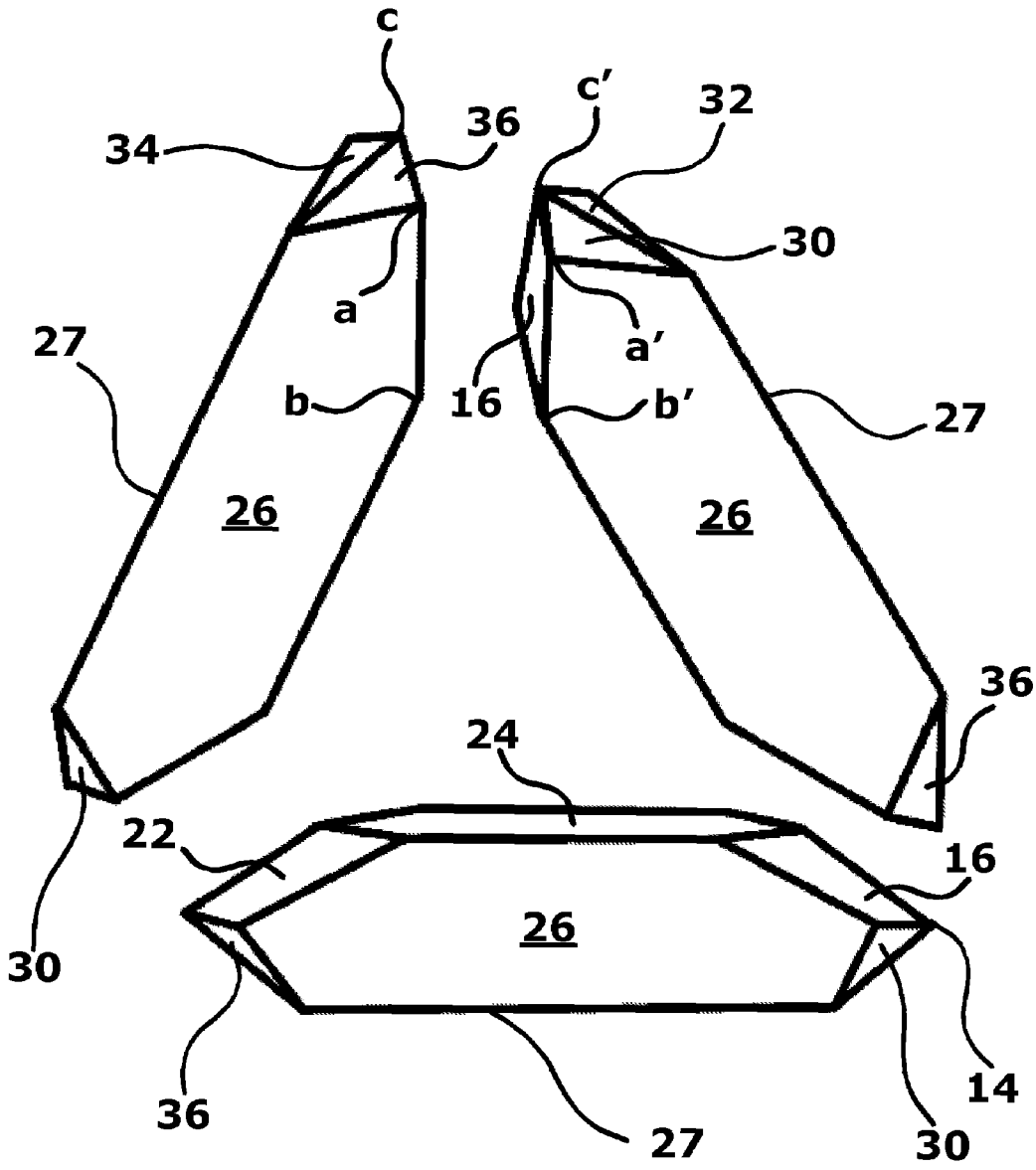
FIGS. 14 and 15 are perspective views detailing how the struts interconnect to form a tetrahedral lattice structure.

FIG. 14 shows a perspective view of three struts 12. As shown, the lower end face 22 of one strut abuts and adjoins a lower end face 22. These respective lower end faces 16,22 are formed so that they are generally identical and fit neatly onto one another. To wit, note that points a, b, and c of lower end face 18 of a first strut will meet and join with points a', b' and c' of lower end face 16 of an adjacent strut. When these faces 16, 22 adjoin as shown, an angled configuration formed to receive another strut 12 (not shown) will be formed by faces 18 of one strut and 20 of its adjoining strut (not viewable in FIG. 14; see FIG. 8) The ends of the struts are formed such that the end faces 16,18, 20, 22 will neatly fit into the angled configuration to form a tetrahedral configuration in three dimensions.

Figure 15:
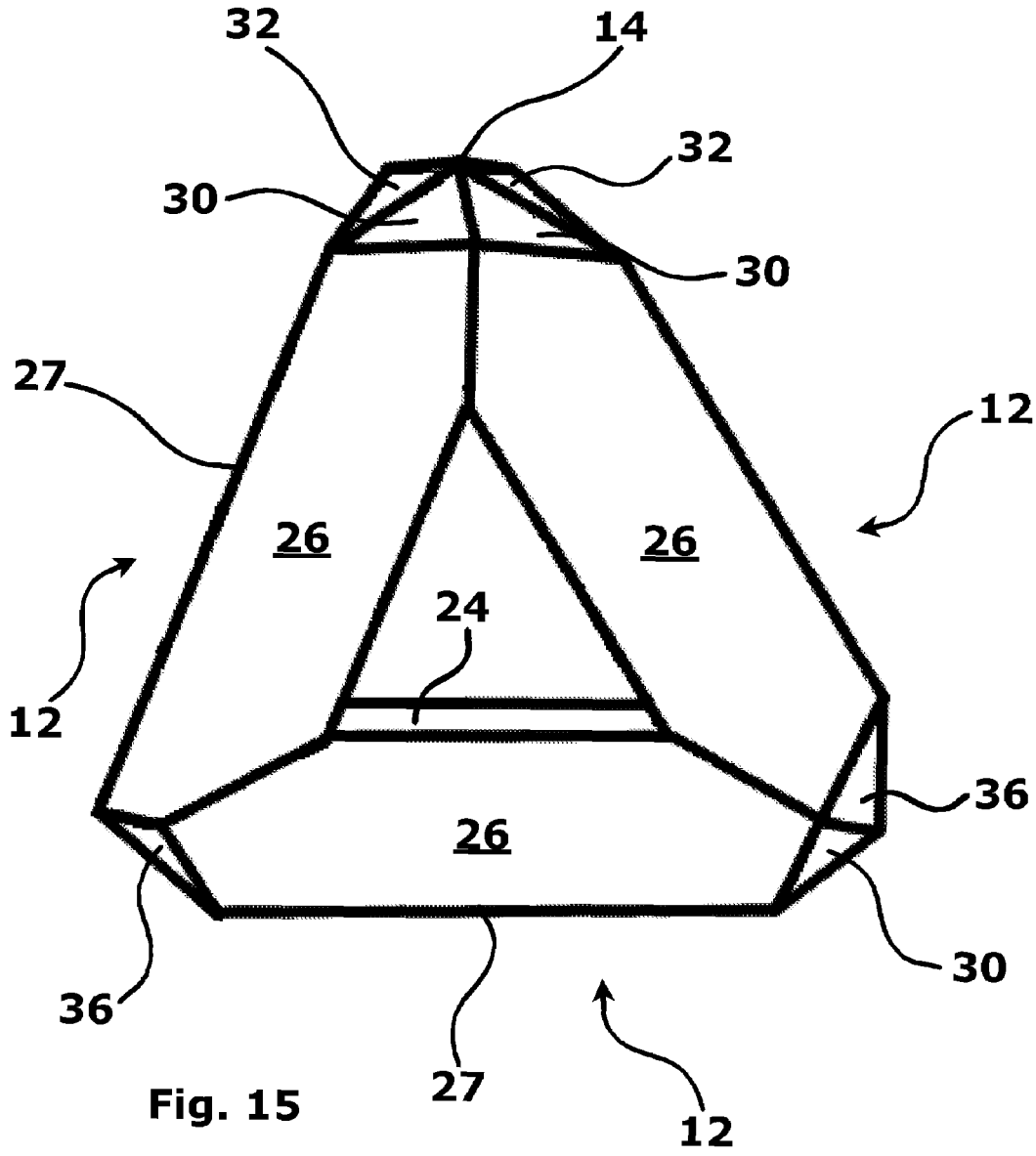

FIG. 15 shows a perspective view detailing how three struts 12 will fit together into a generally planar triangular configuration. The triangular configuration comprises three struts 12 adjoined at respective lower faces (see FIG. 11). In this configuration, the upper faces 30,32, 34,36 of each strut are open to adjoin an adjacent triangular configuration so that a lattice structure of interconnected tetrahedrons will be formed (see FIGS. 1-4).

As shown in FIG. 15, when the three struts are assembled in this manner, the upper faces 30, 32,34,and 36 meet so that the vertex point 14 of each strut 12 abuts to form a single vertex. The spine edge 27 of each strut 12 faces outwardly from the triangular configuration, while the base 24 faces toward the interior of the triangular configuration.

Having described the invention in detail, it is to be understood that this description is for illustrative purposes only. The scope and breadth of the invention shall be limited only by the appended claims.

My invention is as follows:

1. A material composed of a lattice structure of interconnected struts, each strut comprising first and second ends spaced from one another along a generally triangular cross-section at planes perpendicular to a longitudinal axis, the first and second ends being equivalent to one another, each having a vertex point positioned at an outermost point with respect to the longitudinal axis and on a line that symmetrically passes through the triangular cross-section, the vertex point providing an intersection point of a plurality of planar polygonal faces that are symmetric about the line of symmetry;

the material comprising a manifold within each strut that passes a fluid through the manifold.

2. The material of claim 1, wherein the triangular cross section comprises an isosceles triangle.

3. The material of claim 1, the first end comprising:

first and second faces sharing a common edge and angled outwardly toward the vertex, the first and second faces being generally symmetric about the common edge.

4. The material of claim 3, wherein the first and second faces are triangles.

5. The material of claim 1, the first end comprising:

third and fourth faces angled outwardly from a base of the triangular cross section and upwardly, toward the vertex point.

6. The material of claim 5, wherein the third and fourth faces share a single edge that has a first end at the vertex point and a second end on the base of the triangular cross-section.

7. The material of claim 6, wherein the common edge and single edge are coplanar with an altitude of the triangular cross section.

8. The material of claim 1, wherein the manifold includes a duct passing from the first face of the first end to the second face of the second end.

9. The material of claim 1, wherein the manifold includes a duct passing from the second face of the first end to the first face of the second end.

10. The material of claim 1, wherein the manifold includes a duct passing from the third face of the first end to the fourth face of the second end.

11. The material of claim 1, wherein the manifold includes a duct passing from the fourth face of the first end to the third face of the second end.

12. The material of claim 1, further comprising a material poured into the lattice, thereby filling spaces within the lattice structure.

13. A material of interconnected tetrahedrons comprising interconnected struts, each strut comprising first and second ends spaced from one another along an isosceles triangular cross-section at planes perpendicular to a longitudinal axis, the first and second ends being equivalent mirror-images of one another, each having a vertex point positioned at an outermost point with respect to the longitudinal axis and on a line that symmetrically passes through the triangular cross-section, the vertex point providing an intersection point of a plurality of planar polygonal faces that are symmetric about the line of symmetry;

first and second triangular faces with a common edge that is angled outwardly toward the vertex, the first and second faces being generally symmetric about the common edge;

third and fourth faces angled outwardly from a base of the triangular cross section and upwardly toward the vertex point, the third and fourth faces sharing a single edge having a first end at the vertex point and a second end on the base of the triangular cross-section, whereby the common edge and single edge are coplanar with an altitude of the triangular cross section;

a manifold within each strut including a first duct passing from the first face of the first end to the second face of the second end a second duct passing from the second face of the first end to the first face of the second end a third duct passing from the third face of the first end to the fourth face of the second end;

a fourth duct passing from the fourth face of the first end to the third face of the second end; wherein, fluid passes through the manifold.

* * * * *